US005700123A

United States Patent [19]

Rokosh et al.

[11] Patent Number: 5,700,123

[45] Date of Patent: Dec. 23, 1997

[54] DEVICE FOR HOISTING DRYWALL SHEETS WITH AUTOMATED DECK LOADING

[76] Inventors: Thaddeus Jerome Rokosh, 406 Silverthorn Close, Olds, Alberta, Canada, T4H 1B3; Joseph Matthew Rokosh, 1411 Craig Road, Calgary, Alberta, Canada, T2V 2S9

[21] Appl. No.: 665,305

[22] Filed: Jun. 17, 1996

[51] Int. Cl.[6] ..... E04G 21/14

[52] U.S. Cl. ..... 414/11; 52/749

[58] Field of Search ..... 414/11; 52/749, 52/750

[56] References Cited

U.S. PATENT DOCUMENTS

| | | | |
|---|---|---|---|
| 2,443,349 | 6/1948 | Foster | 414/11 |
| 3,178,038 | 4/1965 | Love | 414/11 |
| 4,600,348 | 7/1986 | Pettit | 414/11 |

*Primary Examiner*—Karen B. Merritt
*Assistant Examiner*—Gregory A. Morse

[57] ABSTRACT

A device for lifting drywall to a position where it may be mounted to a wall includes a lifting chain attached to a winch and also includes hooks to hold the drywall. The drywall is positioned on the deck at a lowered position, and the deck may subsequently be raised.

1 Claim, 8 Drawing Sheets

DEVICE FOR HOISTING DRYWALL SHEETS WITH AUTOMATED DECK LOADING

BACKGROUND OF THE INVENTION

1. It is common in devices for hoisting drywall to ceiling or wall location to load the hoisting deck manually.

2. We have found that this difficulty may be overcome by attaching a yoke extending forward from the main stem of the unit and employing a winch to do the loading, thus the use of this device, whose drawings are enclosed.

DETAILED DESCRIPTION OF THE DRAWINGS

Figure 1:
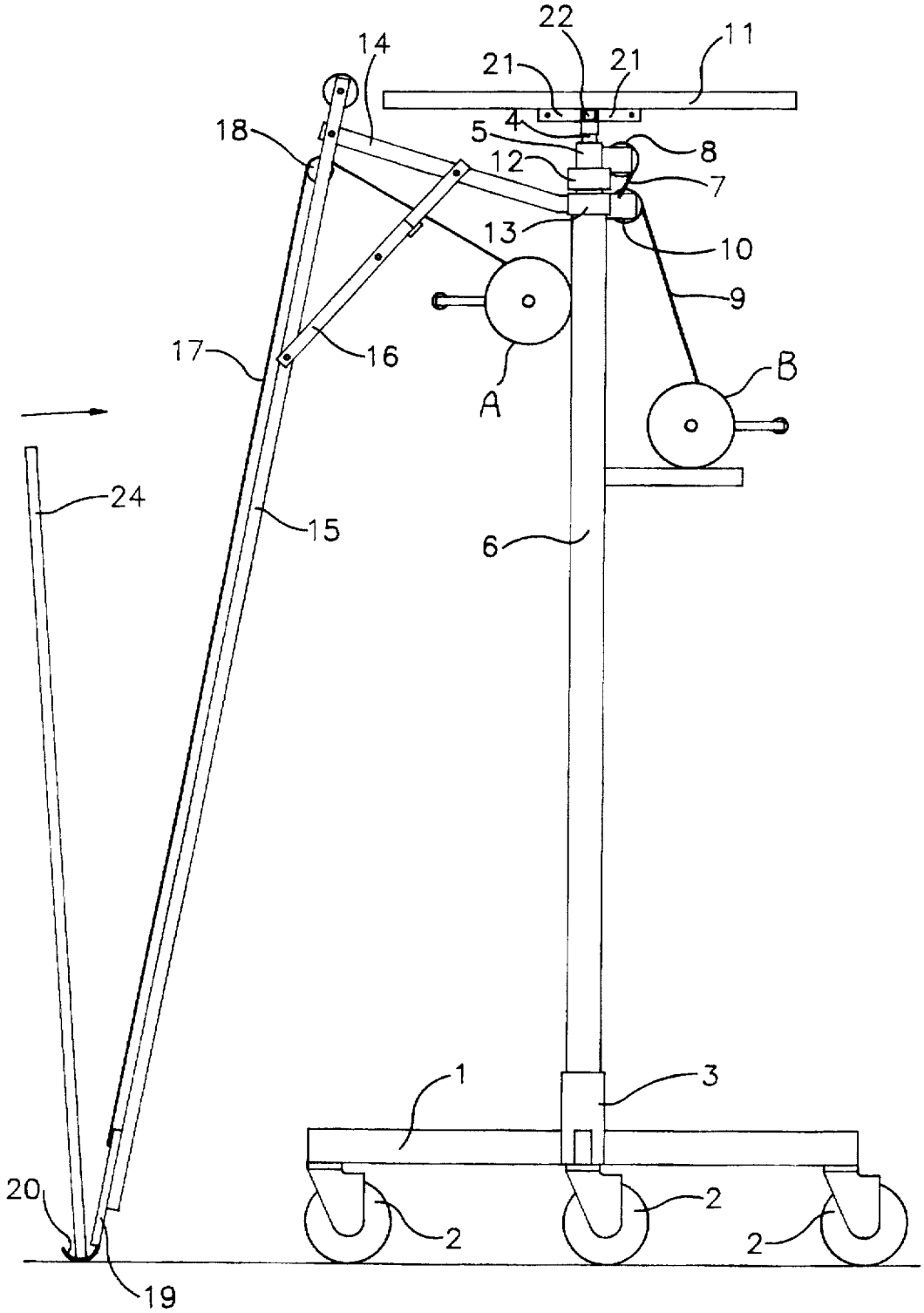
FIG. 1 is a side elevational view that is being loaded with a piece of drywall sheet

The device consists of a four legged portable stand 1 on casters 2 with a central pocket 3 to accommodate the main stem 6 of the unit.

To this stand is attached a vertical pipe 4 within a pipe 5 within main stem 6. The inner pipe 4 is a hoist which is lifted by a cable 7 whose one end is attached to the bottom of the inner pipe 4 and threading upwards through a pulley 8 which is attached to the outside top of inner pipe 5. The other end of cable 7 is anchored to means housing pulley 10. Inner pipe 5 is also a hoist which is lifted by a cable 9 attached to the bottom of inner pipe 5 and threading upwards through a pulley 10 which is attached to the outside top of main stem 6. The other end of cable 9 is attached to winch B. To the top of the inner pipe 4 is attached a hoisting deck 11 whose neck fits onto inner pipe 4. Below the deck 11 and near the top of the inner pipe 5 are attached two pockets . Also below pockets 12 and attached to the outer top of main stem 6 are two more pockets 13. Both pockets 12 and pockets 13 are to accommodate the yoke 14 for separate functions—pockets 12 for wall application and pockets 13 for ceiling application.

For ceiling application of drywall, the yoke 14 is placed in pockets 13. The two sliders 15 and knuckles 16 are attached to the yoke 14. The knuckles 16 must be fully extended for the hoisting procedure.

Cables 17 must be threaded over pulley bar 18 and downward to floor position with one end attached to the hoisting board 19 and the other end attached to winch A.

To load a drywall sheet 24, place the longitudinal edge of the drywall sheet on hooks 20 of the hoisting board 19 and allow the board 24 to lean on the extended oblique sliders 15. Activate winch A until drywall 24 reaches a point of over-balance at yokes 14 second end and drywall 24 will fall flat on hoisting deck 11.

Winch B is now activated to hoist drywall 24 to its desired height to flat ceiling.

To accomplish application to a pitched ceiling, remove one of pins 21 from hoisting deck 11 before loading.

For wall application of drywall, the yoke 14 is placed in pockets 12 while all other functions remain the same. It is advisable however to remove the hoisting deck 11. It will also be necessary to break the knuckles 16 when the unit is nearing a wall, so as to accomplish a vertical position of the drywall.

The hooks 20 will reach a height of 9'6".

The unit is designed to access hallways of 36 inch width.

The unit will handle drywall sheets to lengths of 14 feet by inserting the deck extensions into pockets 22.

DETAILED DESCRIPTION OF THE EMBODIMENTS

Figure 1A:
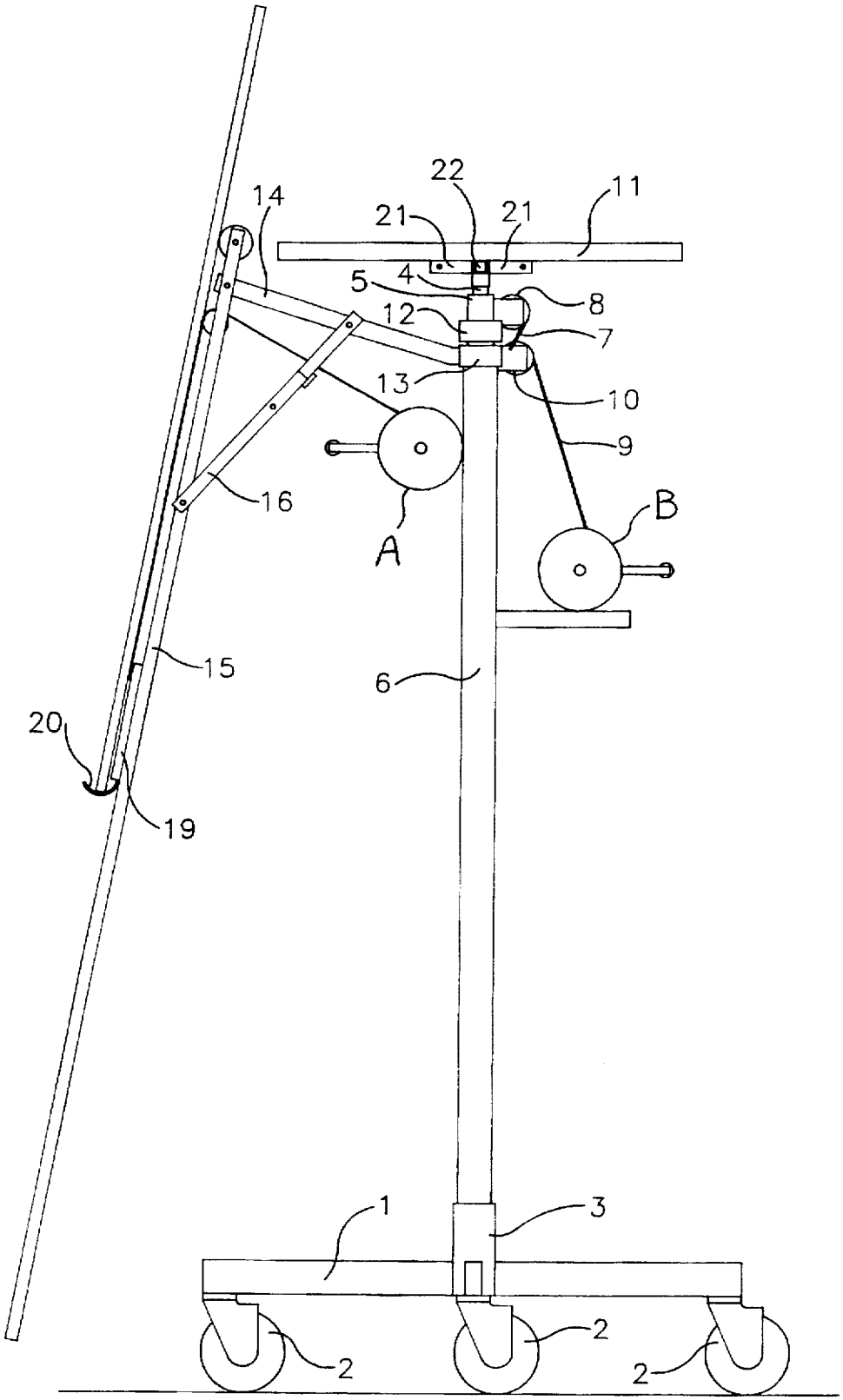
FIG. 1A is a side elevational view showing the sheet of drywall being drawn upwards along the oblique sliders by a winch
Figure 1B:
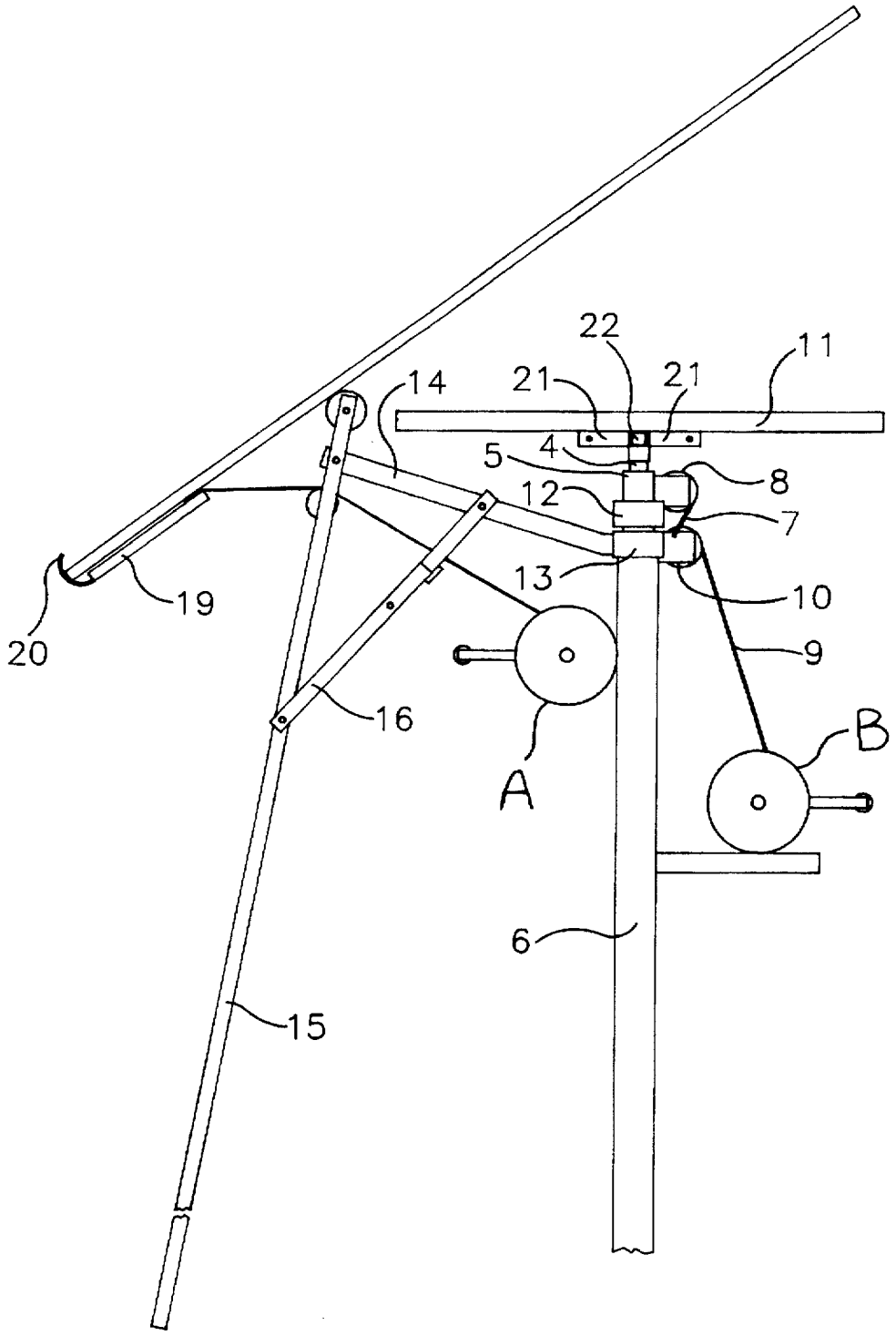
FIG. 1B is a partial side elevational view showing the sheet of drywall being drawn further upwards to an over-balanced position (In the process of falling to a horizontal loading deck.)
Figure 2:
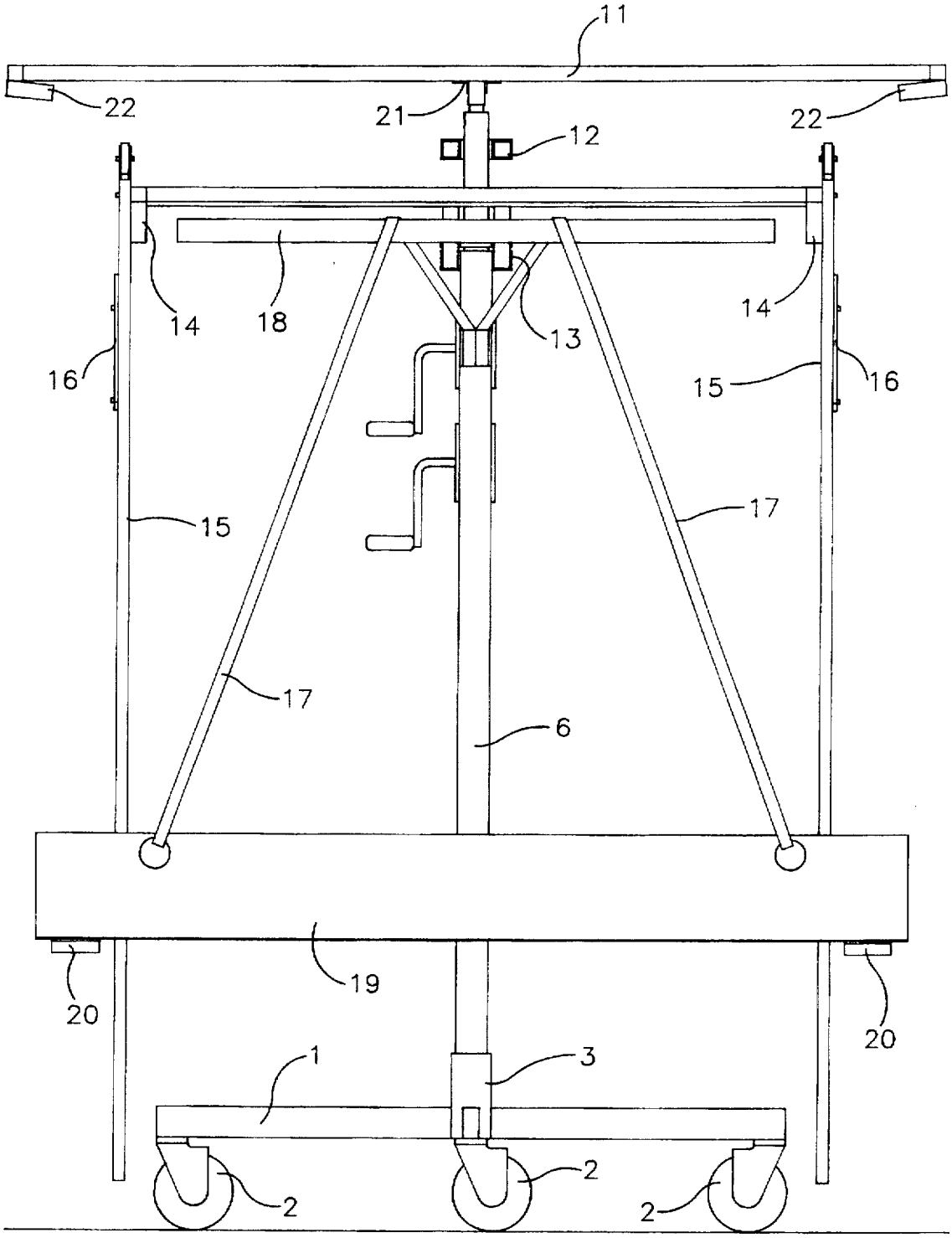
FIG. 2 is a front elevational partially raised view of the hoisting apparatus
Figure 3:
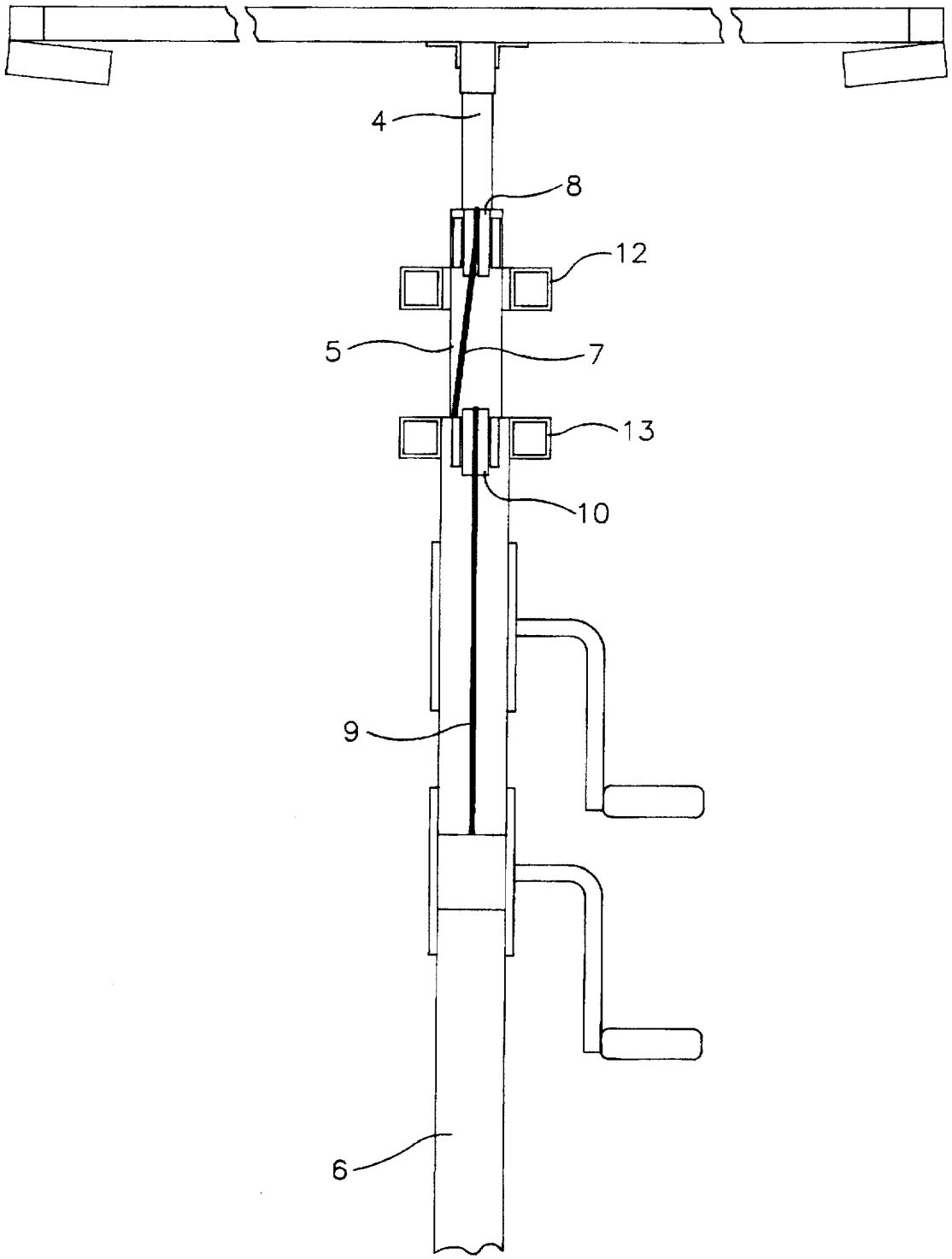
FIG. 3 is an enlarged rear elevational partially raised view showing the sets of pockets on the main stem and inner pipe that frontally receive the first end of the yoke
Figure 4:
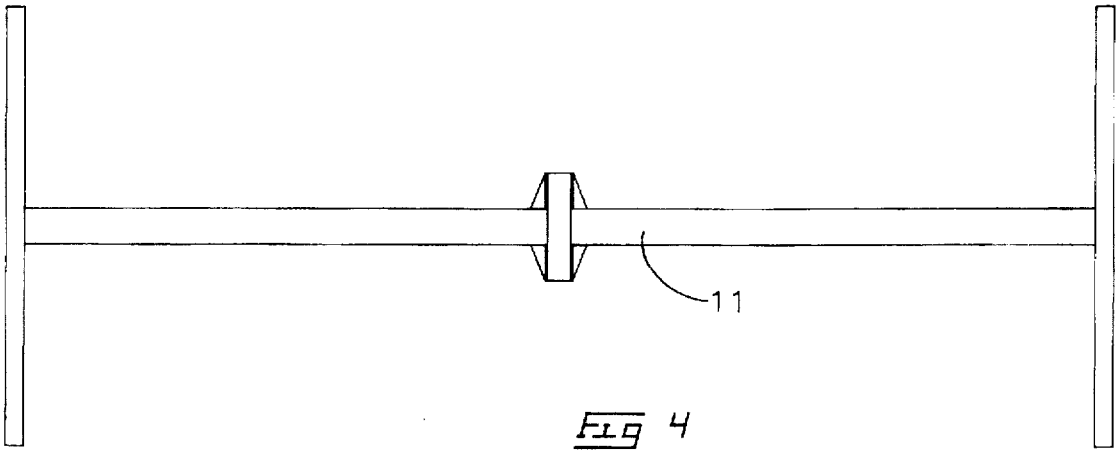
FIG. 4 is a top view of the hoisting deck
Figure 5:
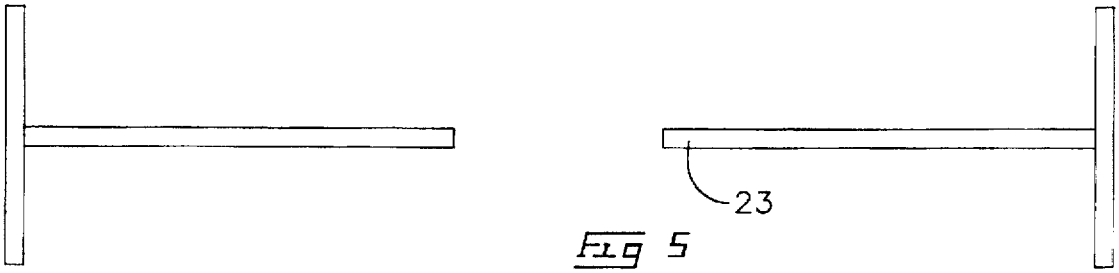
FIG. 5 is a top view of the hoisting deck extensions
Figure 6:
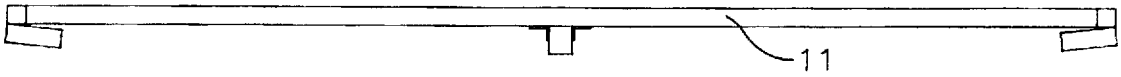
FIG. 6 is a front view of the hoisting deck
Figure 7:
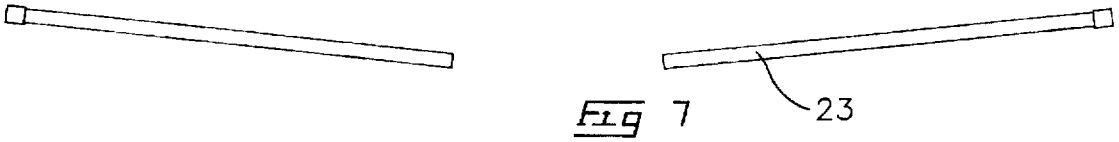
FIG. 7 is a front view of the hoisting deck extensions
Figure 8:
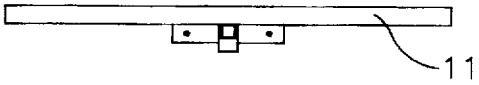
FIG. 8 is a side view of the hoisting deck
Figure 9:
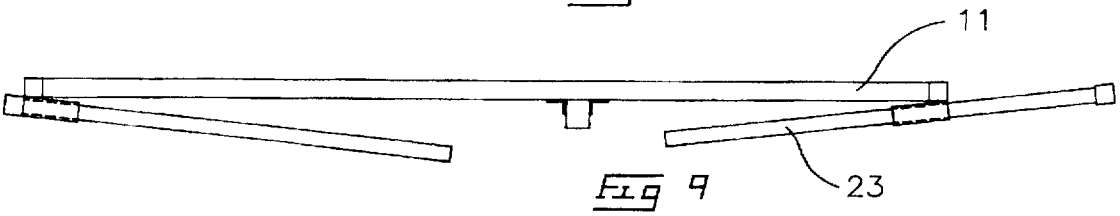
FIG. 9 is a front view of the hoisting deck with deck extensions fully pocketed and partially extended
Figure 10:
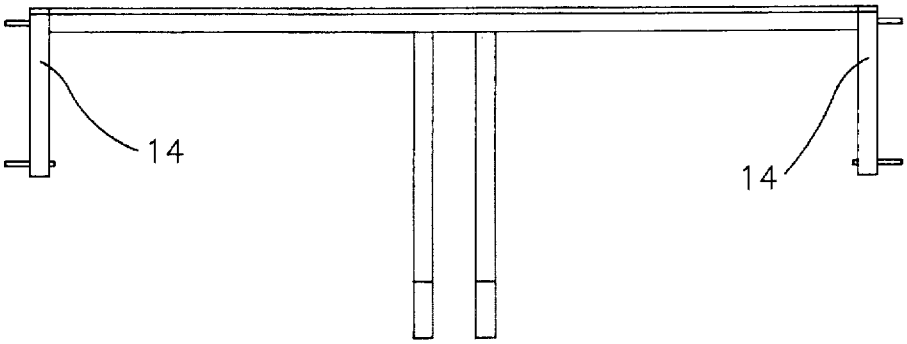
FIG. 10 is a top view of the yoke
Figure 11:
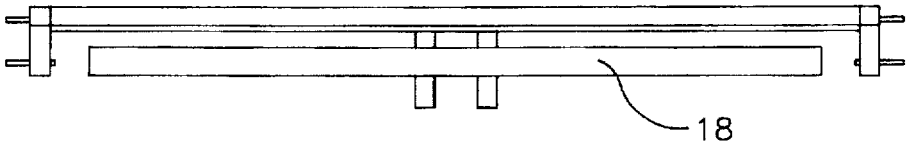
FIG. 11 is a front view of the yoke
Figure 12:
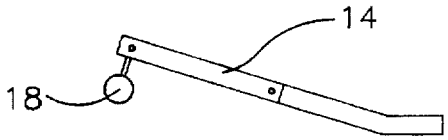
FIG. 12 is a side view of the yoke
Figure 13:
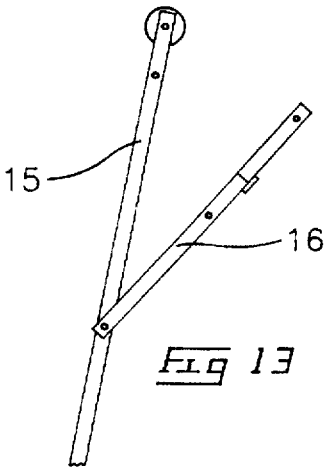
FIG. 13 is a side view of a knuckle (unbroken)
Figure 14:
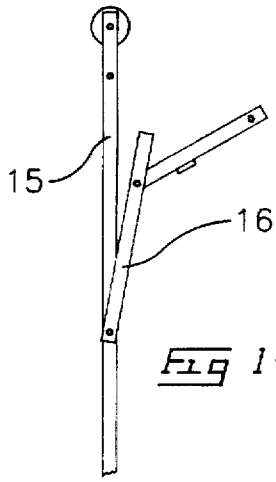
FIG. 14 is a side view of a knuckle (broken)
Figure 15:
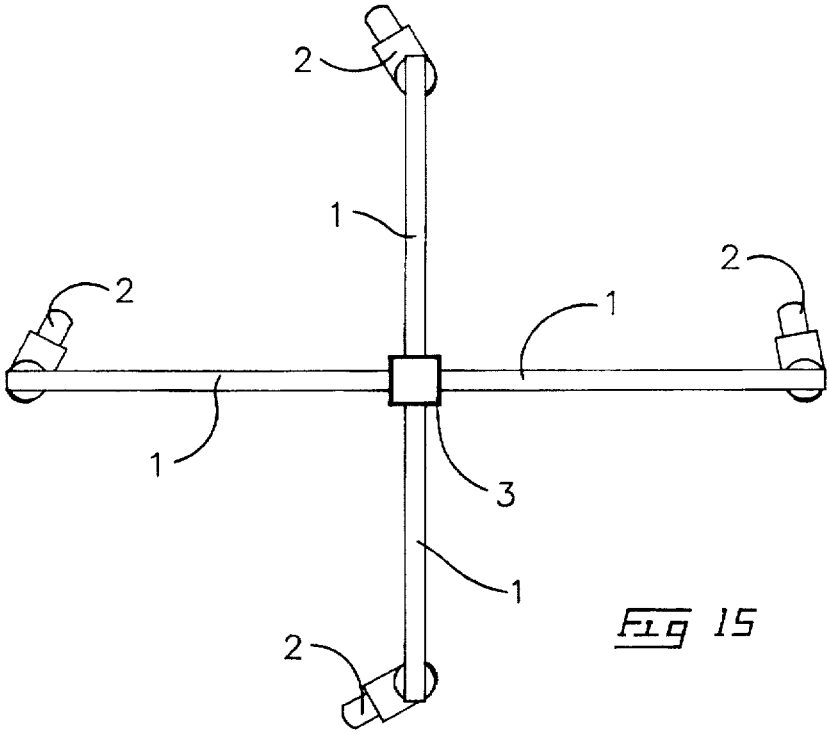
FIG. 15 is a top view of a portable stand
Figure 16:
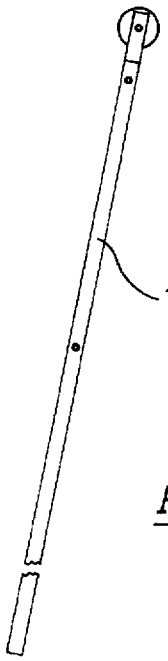
FIG. 16 is a side view of a slider
Figure 17:
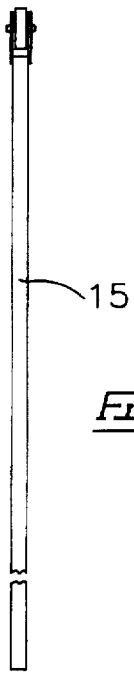
FIG. 17 is a front view of a slider

FIG. 1 Shows the position of the hoisting apparatus in relation to the drywall sheet 24 that rests at its desired location on a floor. With the hooks 20 of hoisting board 19 set on the floor in close proximity to the drywall sheet 24, the sheet 24 is placed on the hooks 20 of the board 19 and allowed to lean on the oblique sliders 15 that are so held in place by the unbroken knuckles 16 near the top of the sliders 15. The winch A is now employed to draw in the hoisting straps 17 and hoisting board 19 bringing with them the drywall sheet 24 in an upward motion as in FIG. 1A and continued to be drawn upwardly until the drywall sheet 24 over-balances at the yokes' 14 second end as in FIG. 1B to fall to the horizontal loading deck 11. The winch A is then released to allow the hoisting board hooks 20 to disengage from the drywall sheet 24. The hoisting board 19 may now be lowered to lift the next drywall sheet.

We claim:

1. A device for positioning drywall comprising:

a stand having a leading leg;

a main stem mounted at its bottom to the stand and having pockets at its top;

an inner pipe located inside the main stem and having pockets at its top;

an elevated horizontal hoisting deck attached to the inner pipe;

a yoke with a first end positionable in either the pockets of the stand or the pockets of the inner pipe;

a hoist for raising the inner pipe relative to the main stem;

an oblique slider attached to a second end of the yoke; and a winch attached to the main stem, the winch having a cable;

whereby the cable may be attached to a piece of drywall and drawn in by the winch, sliding the drywall along the oblique sliders to lift the drywall to the elevated horizontal hoisting deck.

* * * * *